United States Patent [19]

Röck et al.

[11] 4,109,344

[45] Aug. 29, 1978

[54] HINGE WITH CLOSING MEANS

[75] Inventors: Erich Röck, Höchst; Bernhard Mages, Dornbirn, both of Austria

[73] Assignee: Julius Blum Gesellschaft m.b.H., Hochst, Austria

[21] Appl. No.: 811,446

[22] Filed: Jun. 29, 1977

[30] Foreign Application Priority Data

Jul. 19, 1976 [AT] Austria ..... 5286/76

[51] Int. Cl.[2] ..... E05D 11/10

[52] U.S. Cl. ..... 16/144; 16/147

[58] Field of Search ..... 16/144, 141, 145, 147, 16/140, 131, 128, 179; 292/341.15

[56] References Cited

U.S. PATENT DOCUMENTS

| | | | |
|---|---|---|---|
| 3,849,834 | 11/1974 | Mayer | 16/145 |
| 3,952,367 | 4/1976 | Schnelle et al. | 16/147 |
| 3,975,791 | 8/1976 | Hettich et al. | 16/147 |

*Primary Examiner*—Ronald Feldbaum

*Attorney, Agent, or Firm*—Wenderoth, Lind & Ponack

[57] ABSTRACT

A hinge for furniture doors with one hinge axle includes a closing mechanism which is situated in the hinge arm. The closing mechanism has a slidable member into which a part of the hinge casing engages when the door is closed.

10 Claims, 7 Drawing Figures

HINGE WITH CLOSING MEANS

BACKGROUND OF THE INVENTION

1. Field of the Invention

The present invention relates to a hinge, particularly for furniture doors, with a hinge arm which can be directly fixed to a part of the piece of furniture or be indirectly fixed by means of a mounting plate, the hinge arm being connected by means of a hinge axle with a casing which can, for example, be inserted into a door, whereby a snap device is mounted on the hinge.

2. Description of the Prior Art

Hinges of the above-mentioned kind have been frequently used in furniture production and on a particularly large scale in the production of kitchen furniture. It is the advantage of such hinges that they keep the door in position when the door is closed.

It is essential that the closing pressure be exerted only when the door is in a closed or almost closed position, since an automatic and uncontrollable closing of the open door is not desired in most cases. Furthermore, the parts of the snap device and the hinge should not be under unnecessary strain which could result in an early wear of the parts involved.

It is of further advantage if such hinges allow an adjustment of the hinge arm and of the door after the mounting of the hinge. It must be pointed out that with conventional assembly methods for furniture parts the hinge arm, which is usually rigidly connected by a hinge axle with the casing to be inserted into the door, is held by means of the casing on the door when the door is mounted on the side-wall of the piece of furniture. Before assembling the body and the door of the piece of furniture, and also in many cases before assembling the body itself, the so-called mounting plate for the hinge arm is mounted on the side-wall of the body. Only when the piece of furniture is finally assembled is the hinge arm together with the door suspended and fixed on the mounting plate. Because of the adjustability of the hinge arm it is possible to correct any assembly inaccuracies which may be caused when drilling holes for the fastening dowels of the mounting plate.

Various parts of the snap device can be displaced in the course of this adjustment and it is important that this does not affect the snap mechanism.

SUMMARY OF THE INVENTION

It is, therefore, an object of the present invention to provide a hinge of the above-mentioned type which guarantees faultless functioning of the snap device also in case of adjustments in the depth of the piece of furniture or of the door joint.

It is a further object of the present invention to provide a hinge of the above-mentioned type whereby all parts of the snap device which carry out a motion which is relative to their respective hinge parts are mounted within the hinge arm.

It is a further object of the present invention to provide a hinge whereby the door is kept in the closed position under full pressure, but whereby the countereffect of the snap device stops as soon as possible when the door is opened.

According to the invention, these objects are achieved by the provision of a sliding device which is positioned in the hinge arm and which has a slot or the like in which a part of the casing, a bolt for example, engages, whereby a spring mounted in the hinge arm directly or indirectly acts on the sliding device.

It is preferably provided that the sliding device is guided in a chamber-like guide of the hinge arm, such chamber having an aperture on the side of the casing. The engaging part of the hinge casing fits into this aperture, and the major part of the sliding device is covered when the door is opened.

A preferred embodiment of the present invention provides that the part of the hinge arm in which the sliding device is guided is at least approximately positioned in the plane of the door when the door is closed.

A further embodiment provides that the spring acts on the sliding device by means of a bush-shaped member, whereby it is preferably provided that the bush-shaped member is mounted in the hinge arm in such a way that it can be moved in the longitudinal direction. By this arrangement, and due to the fact that an angle is formed between the axis along which the bush-shaped member can be shifted and between the axis along which the sliding device can be shifted, an accurate guiding of the acting force of the spring can be achieved by simple means.

A further preferred embodiment provides that the bush-shaped member has a conical end-portion and that the sliding device has a supporting surface which is correspondingly inclined.

A further possibility for solving the problem of guiding the spring tension according to another embodiment of the invention provides that the spring is fixed to the sliding device by means of a lever which is pivotally mounted on an axle of the hinge arm and which is preferably provided with a protrusion or the like which rests on the sliding device when the door is in the closed position.

A further embodiment of the invention provides that the sliding device has an inclined guiding surface for the counterpart of the spring, i.e. the lever or the bush-shaped member for example, whereby the guiding surface is inclined towards the gliding plane of the sliding device. The intersection line of both planes is positioned on that side of the point of contact with the spring or the counterpart - lever or bush-shaped member - which is turned towards the side-wall of the piece of furniture.

BRIEF DESCRIPTION OF THE DRAWINGS

In the following the invention will be described in detail with reference to the attached drawings, but without being limited to the illustrated embodiments.

DETAILED DESCRIPTION OF THE INVENTION

Figure 3:
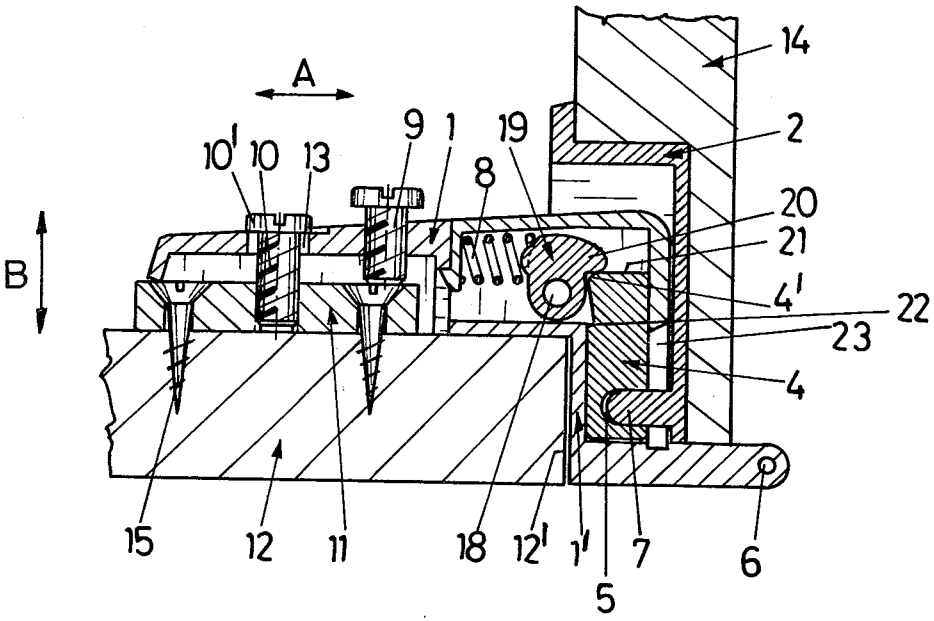
FIG. 3 shows a longitudinal section of a hinge according to FIGS. 1 and 2, when the hinge is closed.
Figure 6:
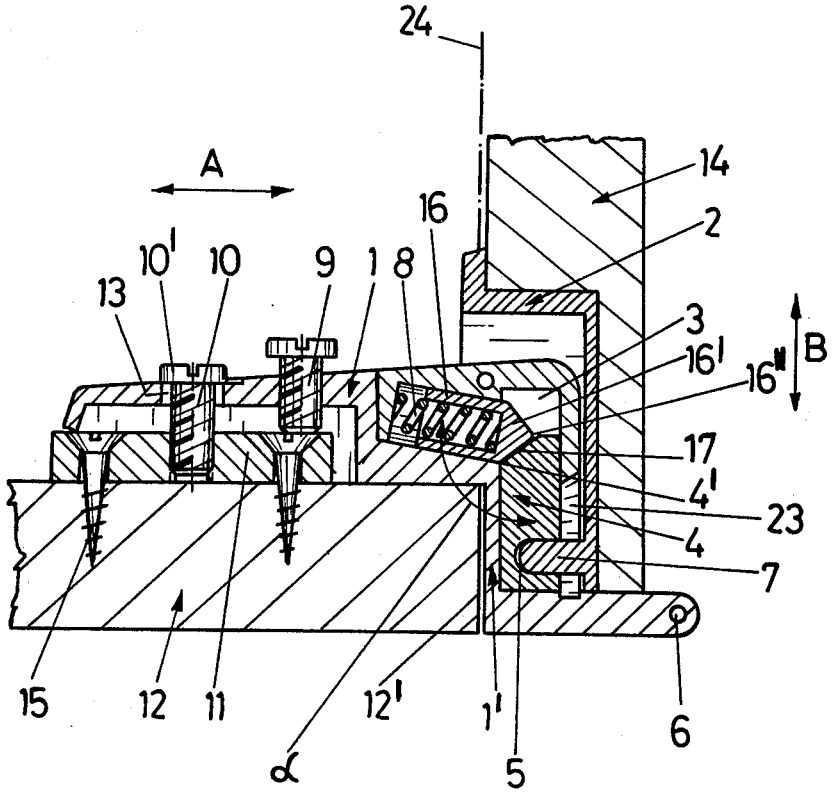
FIG. 6 shows a longitudinal section of a hinge according to FIGS. 4 and 5, when the hinge is closed.
Figure 7:
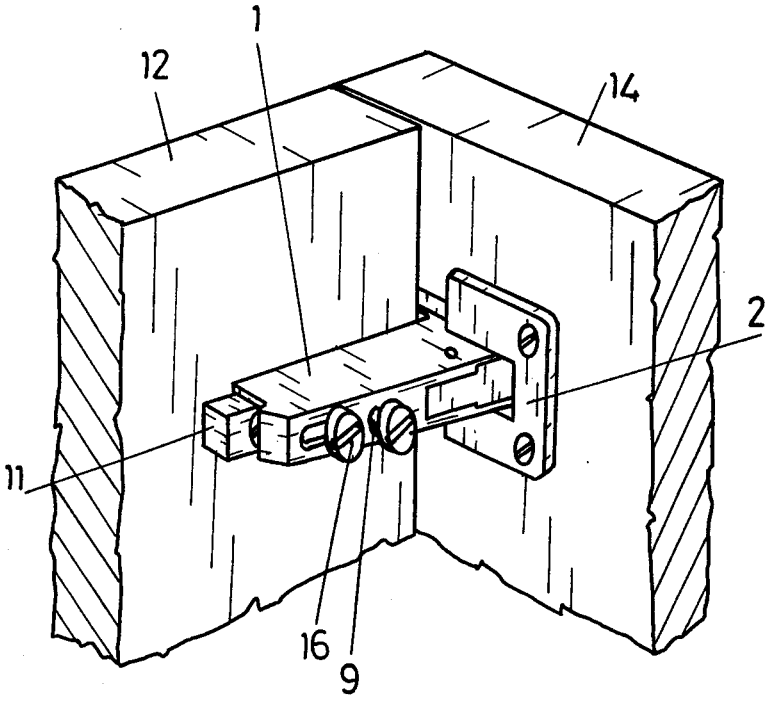
FIG. 7 shows a perspective view of the hinge as assembled to an article of furniture.

In FIGS. 3 and 6 the desired adjustments for the hinge are indicated by double arrows, whereby double arrow A indicates adjustment in the direction of the depth of the piece of furniture, and double arrow B indicates adjustment in the direction of the door joint.

As can be seen in FIGS. 2, 3, 5 and 6 the hinge arm 1 is fixed to the side-wall 12 of the piece of furniture by means of a mounting plate 11. In the illustrated embodiments the mounting plate 11 is screwed to the side-wall 12 by screws 15. The mounting plate 11 can, however, be fastened in any other conventional way, e.g. by means of dowels.

In the illustrated embodiments the hinge arm 1 is connected with the mounting plate 11 by means of a fastening screw 10. The fastening screw 10 is thereby mounted in a thread of the mounting plate 11, and the hinge arm 1 has in the portion thereof adjacent the fastening screw 10 a longitudinal slot 13 through which the fastening screw 10 projects. Head 10' of screw 10 rests against the surface of the hinge arm 1. The hinge arm 1, and thus also the hinge, can be moved over the length of the longitudinal slot 13 and thus in the direction of the depth of the piece of furniture, i.e. in the direction of the double arrow A.

At the front portion of the mounting plate 11, i.e. the end thereof adjacent the door 14, a joint-adjusting screw 9 is mounted in the hinge arm 1, such that screw 9 rests against the mounting plate 11. By relative screwing of the joint-adjusting screw 9 into and out of the hinge arm 1, the hinge arm 1 and the casing 2 connected thereto, as well as the door 14, are moved in the direction of the door joint, i.e. in the direction of the double arrow B.

It must, however, be pointed out that the type of device for holding the hinge arm 1 on the mounting plate 11 and the type of adjustment thereof could be different than that described above, since the hinge according to the invention would have the same advantages even if the hinge arm 1 were fixed to the mounting plate 11 in a different way.

The casing 2 is connected with the hinge arm 1 by means of a hinge axle 6. The side of hinge arm 1 adjacent the door 14 has an angled portion 1' which rests directly against the front side 12' of the side-wall 12 of the piece of furniture, when in the assembled position.

The hinge axle 6 is spaced from the front side 12' of the side-wall of the piece of furniture, and the hinge axle 6 is positioned outside the casing 2 and in the illustrated embodiment outside the door 14. As can be seen in the drawings the hinge arm 1 has a chamber 3 in which a sliding device 4 is mounted. The sliding device 4 has a groove or recess 5 into which a bar or projection 7 of the casing 2 engages when the door is being closed, when it is almost in the closed position, and when it is in the closed position.

Movement of bar 7 during the closing and opening motion of door 14 causes the sliding device 4 to be shifted in the chamber 3 in the direction of the double arrow B.

Figure 5:
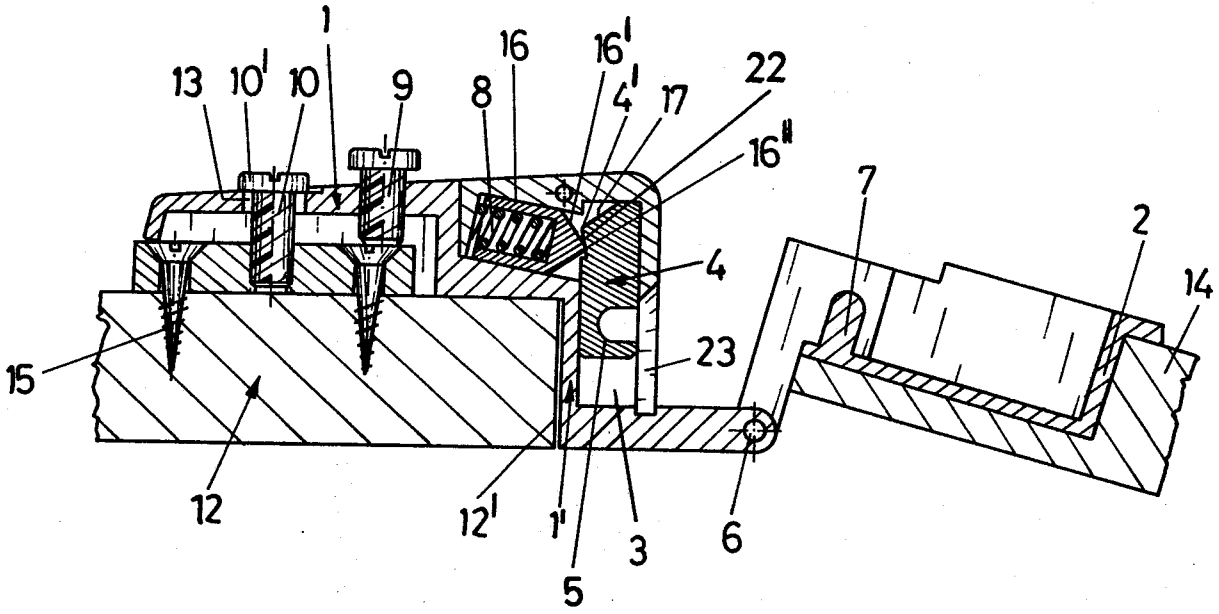
FIG. 5 shows a section along line I—I of FIG. 4.

When the door 14 is being opened, a spiral spring 8, which is also mounted in the hinge arm 1, acts against this shifting. In the embodiment of FIGS. 5 and 6, spiral spring 8 is positioned in an operating member in the form of a bush-shaped member 16 which has a conical end 16' which rests on an inclined supporting surface 17 of the sliding device 4 when the door is closed, as shown in FIG. 6.

When the door 14 is opened, the spring 8 is tensioned between the hinge arm 1 and the sliding device 4 to such an extent that the edge 4' of the sliding device 4 is positioned above the point 16'' of the end 16' of the bush-shaped member (FIG. 5). In the position illustrated in FIG. 5 the spring 8 exerts no closing pressure on the sliding device 4.

When the door 14 is closed again and immediately before the door 14 is in its final closed position, the bar 7 engages again into the groove 5 of the sliding device 4 and pulls the sliding device 4 into the position illustrated in FIG. 6, whereby the spring 8 helps to carry out the final portion of this motion, i.e. the edge 4' of the sliding device is positioned below the point 16'' of the end of the bush-shaped member. Thereafter, the sliding device 4 and thus the door 14 is kept in the closed position by the pressure of the spring 8.

Figure 1:
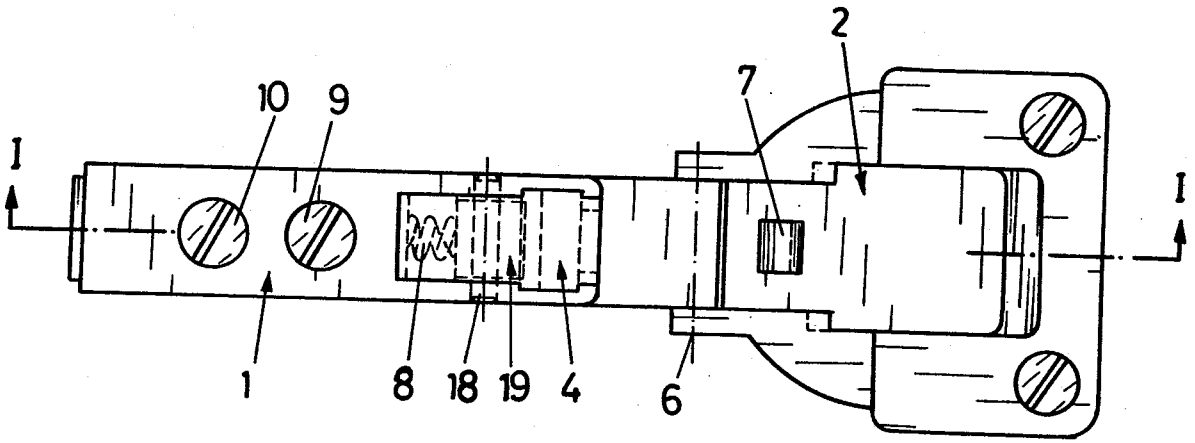
FIG. 1 shows a top view of a first embodiment of a hinge according to the invention.
Figure 2:
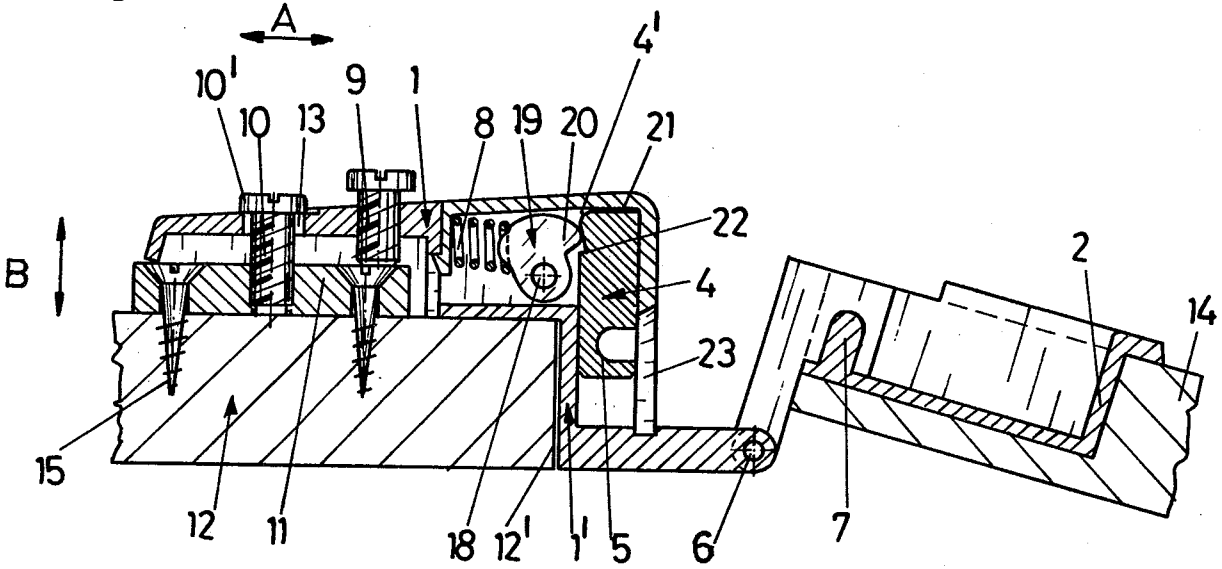
FIG. 2 shows a section along line I—I of FIG. 2.

In the embodiment according to FIGS. 1, 2 and 3 the bush-shaped member 16 is replaced by an operating member in the form of a lever 19 pivotally mounted on an axle 18 of the hinge arm 1. A spiral spring 8 which rests against the hinge arm 1 and the lever 19 is fixed to lever 19.

In this embodiment the lever 19 has a nose or protrusion 20 which engages behind the sliding device 4 in the closed position of the door and acts on the supporting surface 21, thereby pressing the sliding device 4 into the closing direction. In this embodiment the supporting surface 21 is vertical to the sliding direction of device 4.

In this case also, the closing pressure of the spring 8 is exerted on the sliding device 4 until the bar 7 pushes the sliding device 4 in the direction of the position illustrated in FIG. 2, such that the edge or rounded edge 4' of the sliding device 4 glides past the protrusion 20 when the door 14 is opened.

In this position the spring 8 exerts no pressure on the sliding device 4, apart from a clamping force transmitted by the lever 19.

Figure 4:
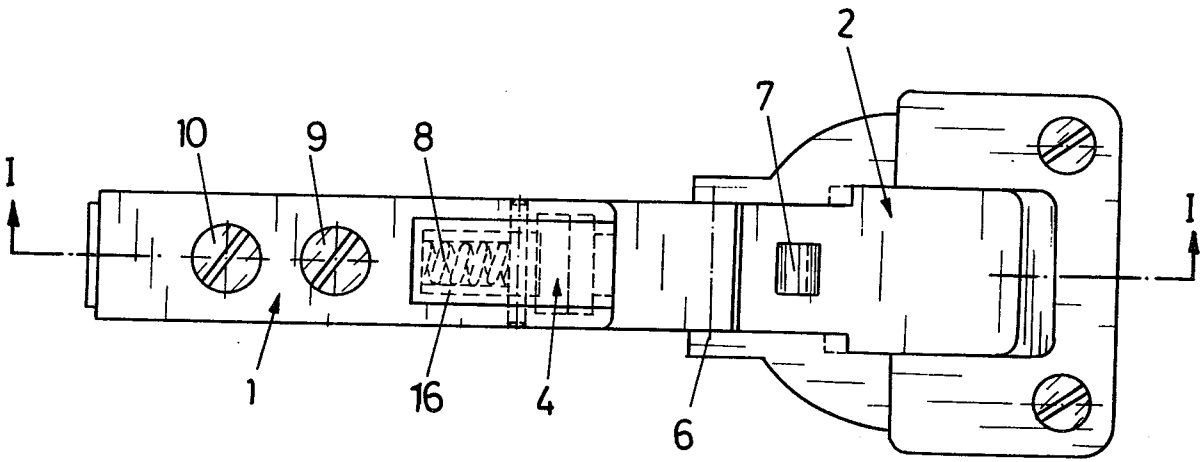
FIG. 4 shows a top view of a second embodiment of a hinge according to the invention.

As can especially be seen in this embodiment, but also in the embodiment according to FIGS. 4, 5 and 6, the sliding device 4 has an inclined guiding surface 22 which is acted upon by the pressure of the spring in such a way that the spring 8 helps to maintain the position of device 4 when the door 14 is open.

It is an essential effect of the inclined guiding surface 22 of the sliding device 4 according to this invention that the sliding device 4 does not automatically slide back into the closed position when the door is open, but rather is kept in the position shown in FIGS. 2 and 5 by the spring 8.

In the illustrated embodiments the chamber 3 is covered and the bar 7 engages into the groove 5 of the sliding device 4 through a hole 23 in the cover of the chamber.

We claim:

1. A hinge, particularly for use in hingedly connecting a furniture door to an article of furniture, said hinge comprising:

a hinge arm adapted to be connected to an article of furniture;

a casing adapted to be connected to a furniture door;

a hinge axle pivotally connecting said casing to said hinge arm, such that said casing, and a furniture door adapted to be connected thereto, are pivotable about said hinge axle between an open first position whereat said casing and the furniture door are spaced from said hinge arm, and an article of furniture adapted to be connected thereto, and a closed second position whereat said casing and the furniture door are closely adjacent said hinge arm and the article of furniture;

said casing having extending therefrom a projection;

said hinge arm having freely slidably positioned thereon a sliding device, said sliding device being slidable in a longitudinal direction between a first door-closed position and a second-door-opened position;

said sliding device having therein a recess positioned such that when said casing is in said closed second position thereof said projection of said casing fits into said recess in said sliding device and retains said sliding device in said first door-closed position thereof, such that movement of said casing from said second position to said first position thereof causes sliding movement of said sliding device from said first position to said second position thereof, and such that movement of said casing from said first position to said second position thereof causes sliding movement of said sliding device from said second position to said first position thereof; and spring biased means acting on said sliding device for retaining said sliding device in said first position thereof when said casing is in said second position thereof, for retarding movement of said sliding device from said first position thereof during an initial portion only of the movement of said sliding device from said first position thereof, for retaining said sliding device in said second position thereof when said casing is in said first position thereof, and for urging said sliding device to said first position thereof during a final portion only of the movement of said sliding device to said first position thereof.

2. A hinge as claimed in claim 1, wherein said sliding device is guided for sliding movement in a chamber within said hinge arm, and said sliding device is slidable in a direction substantially transverse to the plane of an article of furniture adapted to be connected to said hinge arm.

3. A hinge as claimed in claim 2, wherein said hinge arm has an aperture opening into said chamber, said projection of said casing extending through said aperture when said casing is in said second position thereof.

4. A hinge as claimed in claim 1, wherein said sliding device is positioned within the plane of the door adapted to be attached to said casing when said casing is in said second position thereof.

5. A hinge as claimed in claim 1, wherein said spring biased means comprises an operating member, and a compression spring positioned between said hinge arm and said operating member, said compression spring urging said operating member against said sliding device.

6. A hinge as claimed in claim 5, wherein said operating member comprises a bush-shaped member positioned to be urged by said compression spring in a longitudinal direction against said sliding device.

7. A hinge as claimed in claim 6, wherein said direction in which said bush-shaped member is urged and said direction in which said sliding device is slidable extend at an angle to each other.

8. A hinge as claimed in claim 6, wherein said sliding device has an inclined end surface, said bush-shaped member has a conical-shaped end portion which is urged against said inclined end surface of said sliding device when said sliding device is in said first position thereof, and the tip of said conical-shaped end portion being urged into contact with a lateral side surface of said sliding device when said sliding device is in said second position thereof.

9. A hinge as claimed in claim 5, wherein said operating member comprises a lever which is pivotally mounted on said hinge arm, said lever having extending therefrom a protrusion which is urged into contat with an end surface of said sliding device when said sliding device is in said first position thereof and which is urged into contact with a lateral side surface of said sliding device when said sliding device is in said second position thereof.

10. A hinge as claimed in claim 5, wherein said sliding device has on a lateral side thereof an inclined guiding surface which is inclined in a direction toward the plane of said direction of sliding movement of said sliding device, said operating member being urged against said inclined guiding surface when said sliding device is in said second position thereof, and the plane of said inclined guiding surface intersecting the plane of said direction of movement of said sliding device at a position between an article of furniture adapted to be connected to said hinge arm and the point of contact between said operating member and said inclined guiding surface.

* * * * *